US007941937B2

(12) United States Patent
Do

(10) Patent No.: US 7,941,937 B2
(45) Date of Patent: May 17, 2011

(54) LAUNDRY DRYER CONTROL METHOD

(75) Inventor: Gi Hyeong Do, Changwon-si (KR)

(73) Assignee: LG Electronics Inc., Seoul (KR)

( * ) Notice: Subject to any disclaimer, the term of this patent is extended or adjusted under 35 U.S.C. 154(b) by 739 days.

(21) Appl. No.: 10/717,610

(22) Filed: Nov. 21, 2003

(65) Prior Publication Data

US 2004/0143992 A1 Jul. 29, 2004

(30) Foreign Application Priority Data

Nov. 26, 2002 (KR) ..... 10-2002-0074067

(51) Int. Cl.
*F26B 7/00* (2006.01)

(52) U.S. Cl. ..... 34/381; 34/499; 34/413; 34/513; 34/520; 73/862.192; 68/20; 68/13 R; 219/201; 8/151; 8/158; 705/14; 392/382; 392/384

(58) Field of Classification Search ..... 34/493, 34/494, 495, 499, 595, 606, 527, 549, 381, 34/413, 513, 520; 73/862.192; 68/20, 13 R; 392/382, 384; 705/14; 219/201; 8/151, 8/158

See application file for complete search history.

(56) References Cited

U.S. PATENT DOCUMENTS 1,887,687 A * 11/1932 Killeffer ..... 62/99
1,953,160 A * 4/1934 Fuke ..... 34/130
1,956,062 A * 4/1934 Duvall ..... 34/629
1,974,231 A * 9/1934 Bighouse ..... 110/226
1,988,677 A * 1/1935 Arnold ..... 432/45
2,036,578 A * 4/1936 Keyes ..... 432/2
2,104,135 A * 1/1938 Morrill ..... 34/82
2,108,084 A * 2/1938 Strobridge ..... 34/610
2,109,704 A * 3/1938 Morrill ..... 34/66
2,203,686 A * 6/1940 Kline et al. ..... 34/625
2,302,908 A * 11/1942 Fryer et al. ..... 34/350
2,309,771 A * 2/1943 Jordan ..... 34/626
2,341,615 A * 2/1944 Hoffman ..... 425/72.2
2,360,915 A * 10/1944 Vermilya ..... 34/393
2,366,484 A * 1/1945 Bradner ..... 34/647
2,374,598 A * 4/1945 Gray ..... 554/1
2,381,881 A * 8/1945 Rothrock ..... 106/252
2,381,882 A * 8/1945 Cupery ..... 106/252
2,386,203 A * 10/1945 Field ..... 118/33
2,388,298 A * 11/1945 Stephens ..... 426/461
2,401,927 A * 6/1946 Hadley ..... 68/5 R
2,458,358 A * 1/1949 Evans ..... 502/45
2,466,297 A * 4/1949 Ball et al. ..... 34/136
2,466,870 A * 4/1949 Twiehaus et al. ..... 266/144
2,543,618 A * 2/1951 Wood ..... 34/256

(Continued)

FOREIGN PATENT DOCUMENTS

DE 3215418 * 10/1983 ..... 34/550 X (Continued)

*Primary Examiner* — Stephen M. Gravini
(74) *Attorney, Agent, or Firm* — McKenna Long & Aldridge LLP

(57) ABSTRACT

A laundry drier control method reads a temperature variation rate per unit time, to enable drying according to the amount and type of an object being dried. The method includes steps of initiating a drying procedure; measuring a temperature variation rate per unit time over the drying procedure; calculating an overall drying time based on the measured temperature variation rate per unit time; and performing the drying procedure for the calculated overall drying time. The drying time determining step is repeated if a substantial increase in the temperature variation rate is detected.

6 Claims, 5 Drawing Sheets

U.S. PATENT DOCUMENTS

| | | | | | |
|---|---|---|---|---|---|
| 2,567,983 | A | * | 9/1951 | Wood | 34/256 |
| 2,581,148 | A | * | 1/1952 | Scull et al. | 426/466 |
| 2,619,676 | A | * | 12/1952 | Miller et al. | 264/37.17 |
| 2,629,162 | A | * | 2/1953 | Peck | 26/72 |
| 2,644,681 | A | * | 7/1953 | Scull et al. | 432/152 |
| 2,664,245 | A | * | 12/1953 | O'Connor et al. | 236/14 |
| 2,666,463 | A | * | 1/1954 | Heritage | 144/361 |
| 2,671,009 | A | * | 3/1954 | Comstock | 423/497 |
| 2,720,037 | A | * | 10/1955 | Erickson | 34/526 |
| 2,720,710 | A | * | 10/1955 | Erisman | 34/479 |
| 2,746,170 | A | * | 5/1956 | Wilson et al. | 34/109 |
| 2,794,266 | A | * | 6/1957 | Bradfield | 34/147 |
| 2,836,901 | A | * | 6/1958 | Davis | 34/413 |
| 2,837,831 | A | * | 6/1958 | Gates | 34/92 |
| 2,837,834 | A | * | 6/1958 | Alexeff et al. | 34/648 |
| 2,908,035 | A | * | 10/1959 | De Haan | 34/634 |
| 2,915,293 | A | * | 12/1959 | Daane et al. | 165/88 |
| 2,924,550 | A | * | 2/1960 | Friedman | 162/224 |
| 2,932,901 | A | * | 4/1960 | Salem | 34/393 |
| 2,948,966 | A | * | 8/1960 | Hanson | 34/255 |
| 2,952,078 | A | * | 9/1960 | Litzler | 34/68 |
| 2,959,869 | A | * | 11/1960 | Ackerman | 34/135 |
| 3,028,680 | A | * | 4/1962 | Conlee et al. | 34/145 |
| 3,044,180 | A | * | 7/1962 | Block et al. | 34/429 |
| 3,078,589 | A | * | 2/1963 | Carlson | 34/77 |
| 3,084,531 | A | * | 4/1963 | Matheny | 68/210 |
| 3,102,794 | A | * | 9/1963 | Arnold | 34/371 |
| 3,123,448 | A | * | 3/1964 | Fleer | 34/527 |
| 3,131,034 | A | * | 4/1964 | Marsh | 34/496 |
| 3,137,546 | A | * | 6/1964 | Lamb | 34/371 |
| 3,161,481 | A | * | 12/1964 | Edwards | 34/527 |
| 3,175,300 | A | * | 3/1965 | Nitchie | 34/549 |
| 3,176,412 | A | * | 4/1965 | Gardner | 34/122 |
| 3,204,341 | A | * | 9/1965 | Whitsel, Jr. | 34/520 |
| 3,213,547 | A | * | 10/1965 | Trettel | 34/412 |
| 3,218,138 | A | * | 11/1965 | Mennerich | 65/382 |
| 3,226,840 | A | * | 1/1966 | Moser et al. | 34/419 |
| 3,269,142 | A | * | 8/1966 | De Mola et al. | 62/381 |
| 3,273,256 | A | * | 9/1966 | Behrens | 34/546 |
| 3,277,581 | A | * | 10/1966 | Towery et al. | 34/491 |
| 3,281,957 | A | * | 11/1966 | Ranney et al. | 34/642 |
| 3,299,526 | A | * | 1/1967 | Arnold et al. | 34/380 |
| 3,328,894 | A | * | 7/1967 | Smith, Jr. | 34/583 |
| 3,337,965 | A | * | 8/1967 | Whitsel, Jr. | 34/520 |
| 3,363,326 | A | * | 1/1968 | Weeks | 34/528 |
| 3,364,594 | A | * | 1/1968 | Gruver | 34/658 |
| 3,367,038 | A | * | 2/1968 | Bishop, Sr. | 34/485 |
| 3,396,476 | A | * | 8/1968 | Eaves | 34/484 |
| 3,399,460 | A | * | 9/1968 | Russell | 34/255 |
| 3,403,454 | A | * | 10/1968 | Smith, Jr. | 34/68 |
| 3,403,455 | A | * | 10/1968 | Wilson | 34/647 |
| 3,429,056 | A | * | 2/1969 | Metzger | 34/601 |
| 3,443,505 | A | * | 5/1969 | Kaufman, Jr. | 99/517 |
| 3,447,247 | A | * | 6/1969 | Daane | 34/122 |
| 3,458,890 | A | * | 8/1969 | Neal | 15/306.1 |
| 3,543,358 | A | * | 12/1970 | Breen et al. | 264/168 |
| 3,548,171 | A | * | 12/1970 | Kodz | 700/210 |
| 3,553,848 | A | * | 1/1971 | Kuroki et al. | 34/115 |
| 3,583,689 | A | * | 6/1971 | Gildener | 432/239 |
| 3,590,495 | A | * | 7/1971 | Tyson et al. | 34/654 |
| 3,619,908 | A | * | 11/1971 | Kallas | 34/573 |
| 3,621,585 | A | * | 11/1971 | Robertson | 34/375 |
| 3,650,042 | A | * | 3/1972 | Boerger et al. | 34/611 |
| 3,709,005 | A | * | 1/1973 | Keating et al. | 68/6 |
| 3,714,716 | A | * | 2/1973 | Dedrick | 34/495 |
| 3,718,982 | A | * | 3/1973 | Deaton | 34/82 |
| 3,739,491 | A | * | 6/1973 | Creapo et al. | 34/644 |
| 3,765,102 | A | * | 10/1973 | Fischer | 34/136 |
| 3,787,985 | A | * | 1/1974 | Fowler et al. | 34/527 |
| 3,792,956 | A | * | 2/1974 | Hyldon | 426/619 |
| 3,882,612 | A | * | 5/1975 | Try et al. | 34/479 |
| 3,915,708 | A | * | 10/1975 | Zausmer et al. | 430/150 |
| 3,989,934 | A | * | 11/1976 | Fay | 700/123 |
| 3,989,935 | A | * | 11/1976 | Fay | 700/208 |
| 4,012,847 | A | * | 3/1977 | Rand | 34/75 |
| 4,031,354 | A | * | 6/1977 | D'Souza | 219/389 |
| 4,057,908 | A | * | 11/1977 | Mirliss et al. | 34/360 |
| 4,071,962 | A | * | 2/1978 | Saeman | 34/135 |
| 4,072,220 | A | * | 2/1978 | Hamada | 477/174 |
| 4,096,643 | A | * | 6/1978 | Futcher | 34/122 |
| 4,123,851 | A | * | 11/1978 | Itoh et al. | 34/549 |
| 4,231,166 | A | * | 11/1980 | McMillan | 34/553 |
| 4,250,628 | A | * | 2/1981 | Smith et al. | 34/260 |
| 4,254,557 | A | * | 3/1981 | Mayer et al. | 34/249 |
| 4,254,558 | A | * | 3/1981 | Mayer | 34/249 |
| 4,257,170 | A | * | 3/1981 | Gestblom et al. | 34/553 |
| 4,267,643 | A | * | 5/1981 | Haried | 34/553 |
| 4,343,769 | A | * | 8/1982 | Henkelmann | 422/109 |
| 4,412,389 | A | * | 11/1983 | Kruger | 34/535 |
| 4,492,042 | A | * | 1/1985 | Otabe et al. | 34/514 |
| 4,531,305 | A | * | 7/1985 | Nagayasu et al. | 34/445 |
| 4,535,550 | A | * | 8/1985 | Walter | 34/499 |
| 4,547,977 | A | * | 10/1985 | Tenedini et al. | 34/538 |
| 4,558,525 | A | * | 12/1985 | Duske et al. | 34/128 |
| 4,612,802 | A | * | 9/1986 | Clarke et al. | 73/73 |
| 4,622,762 | A | * | 11/1986 | Reed | 34/638 |
| 4,655,041 | A | * | 4/1987 | Del Vecchio et al. | 60/646 |
| 4,674,976 | A | * | 6/1987 | Naohara et al. | 432/11 |
| 4,679,160 | A | * | 7/1987 | Whitener | 702/171 |
| 4,689,895 | A | * | 9/1987 | Taylor et al. | 34/428 |
| 4,696,115 | A | * | 9/1987 | Spadafora | 34/524 |
| 4,699,048 | A | * | 10/1987 | Pavan | 99/470 |
| 4,713,894 | A | * | 12/1987 | Roth et al. | 34/486 |
| 4,750,117 | A | * | 6/1988 | Gregory | 702/171 |
| 4,750,273 | A | * | 6/1988 | Parkes et al. | 34/484 |
| 4,763,424 | A | * | 8/1988 | Taylor et al. | 34/428 |
| 4,767,629 | A | * | 8/1988 | Iglesias et al. | 426/55 |
| 4,774,831 | A | * | 10/1988 | Nordin | 73/75 |
| 4,800,653 | A | * | 1/1989 | Steffen | 34/495 |
| 4,827,627 | A | * | 5/1989 | Cardoso | 34/526 |
| 4,832,711 | A | * | 5/1989 | Christel et al. | 95/14 |
| 4,887,365 | A | * | 12/1989 | Oda | 34/60 |
| 4,888,885 | A | * | 12/1989 | Caughey | 34/503 |
| 4,953,298 | A | * | 9/1990 | Carter et al. | 34/526 |
| 5,038,495 | A | * | 8/1991 | Jacobs et al. | 34/62 |
| 5,067,254 | A | * | 11/1991 | Linkletter et al. | 34/137 |
| 5,096,017 | A | * | 3/1992 | Rey et al. | 181/0.5 |
| 5,101,575 | A | * | 4/1992 | Bashark | 34/562 |
| 5,105,558 | A | * | 4/1992 | Curry | 34/449 |
| 5,142,796 | A | * | 9/1992 | Anzai et al. | 34/62 |
| 5,147,690 | A | * | 9/1992 | Faust et al. | 427/372.2 |
| 5,161,314 | A | * | 11/1992 | Souza | 34/493 |
| 5,197,203 | A | * | 3/1993 | Lenoir | 34/90 |
| 5,207,764 | A | * | 5/1993 | Akabane et al. | 68/20 |
| 5,245,377 | A | * | 9/1993 | Samuels et al. | 396/572 |
| 5,262,816 | A | * | 11/1993 | Samuels et al. | 396/572 |
| 5,299,362 | A | * | 4/1994 | Baldinger | 34/273 |
| 5,303,484 | A | * | 4/1994 | Hagen et al. | 34/656 |
| 5,316,783 | A | * | 5/1994 | Kratochvil et al. | 426/627 |
| 5,321,900 | A | * | 6/1994 | Meyer | 34/180 |
| 5,347,727 | A | * | 9/1994 | Kim | 34/491 |
| 5,390,400 | A | * | 2/1995 | Jacob et al. | 28/274 |
| 5,401,960 | A | * | 3/1995 | Fisun et al. | 250/271 |
| 5,452,524 | A | * | 9/1995 | Isozaki et al. | 34/454 |
| 5,459,945 | A | * | 10/1995 | Shulenberger | 34/605 |
| 5,502,475 | A | * | 3/1996 | Kaburagi et al. | 347/102 |
| 5,524,363 | A | * | 6/1996 | Seidl et al. | 34/629 |
| 5,525,239 | A | * | 6/1996 | Duske | 210/739 |
| 5,548,907 | A | * | 8/1996 | Gourdine | 34/448 |
| 5,564,199 | A | * | 10/1996 | Yamamoto et al. | 34/398 |
| 5,579,590 | A | * | 12/1996 | Seidl et al. | 34/559 |
| 5,581,909 | A | * | 12/1996 | Ueda et al. | 34/636 |
| 5,608,212 | A | * | 3/1997 | Merilainen et al. | 250/252.1 |
| 5,634,402 | A | * | 6/1997 | Rudd et al. | 101/424.1 |
| 5,682,684 | A | * | 11/1997 | Wentzlaff et al. | 34/495 |
| 5,689,900 | A | * | 11/1997 | Takayama et al. | 34/631 |
| 5,699,625 | A | * | 12/1997 | Iguchi | 34/62 |
| 5,736,025 | A | * | 4/1998 | Smith et al. | 204/621 |
| 5,737,851 | A | * | 4/1998 | Novak et al. | 34/420 |
| 5,755,042 | A | * | 5/1998 | Takayama et al. | 34/613 |
| 5,810,471 | A | * | 9/1998 | Nath et al. | 366/25 |
| 5,840,583 | A | * | 11/1998 | Barclay et al. | 436/55 |
| 5,878,566 | A | * | 3/1999 | Endo et al. | 60/773 |
| 5,908,290 | A | * | 6/1999 | Kawamura et al. | 432/59 |
| 5,929,581 | A | * | 7/1999 | Van Brocklin et al. | 318/471 |
| 5,937,848 | A | * | 8/1999 | Madden | 126/247 |
| 5,940,988 | A | * | 8/1999 | Eisen | 34/596 |

5,972,711 A * 10/1999 Barclay et al. ..... 436/55
5,974,688 A * 11/1999 Domingue et al. ..... 34/269
6,011,371 A * 1/2000 Van Brocklin et al. ..... 318/471
6,035,547 A * 3/2000 Hess et al. ..... 34/270
6,041,516 A * 3/2000 Preszler et al. ..... 34/392
6,079,118 A * 6/2000 Kiyokawa ..... 34/134
6,108,942 A * 8/2000 Fezer ..... 34/636
6,158,148 A * 12/2000 Krausch ..... 34/497
6,159,257 A * 12/2000 Koutlakis et al. ..... 51/302
6,223,449 B1 * 5/2001 Johnson et al. ..... 34/62
6,223,451 B1 * 5/2001 Satake et al. ..... 34/134
6,226,891 B1 * 5/2001 Chapman ..... 34/508
6,230,479 B1 * 5/2001 Kawamura et al. ..... 60/773
6,303,530 B1 * 10/2001 Schwartz et al. ..... 502/66
6,310,125 B1 * 10/2001 Rayner ..... 524/195
6,421,931 B1 * 7/2002 Chapman ..... 34/424
6,455,825 B1 * 9/2002 Bentley et al. ..... 219/665
6,464,322 B2 * 10/2002 Dunand ..... 347/19
6,519,871 B2 * 2/2003 Gardner et al. ..... 34/497
6,544,708 B2 * 4/2003 Komoto et al. ..... 430/124.32
6,566,636 B1 * 5/2003 Bentley et al. ..... 219/665
6,596,457 B1 * 7/2003 Hidaka et al. ..... 430/270.1
6,637,128 B2 * 10/2003 Kuroiwa et al. ..... 34/629
6,694,639 B2 * 2/2004 Hanaya ..... 34/115
6,735,883 B1 * 5/2004 Bria et al. ..... 34/444
6,742,277 B2 * 6/2004 Sakurazawa ..... 34/236
6,753,512 B1 * 6/2004 Triplett et al. ..... 219/497
6,773,802 B2 * 8/2004 Kobayashi et al. ..... 428/847.4
6,775,925 B2 * 8/2004 Zagar et al. ..... 34/618
6,792,694 B2 * 9/2004 Lapierre ..... 34/446
6,818,369 B2 * 11/2004 Sugiura et al. ..... 430/108.1
6,826,267 B2 * 11/2004 Daum et al. ..... 379/102.03
6,835,521 B2 * 12/2004 Tsuji et al. ..... 430/137.17
6,852,667 B2 * 2/2005 Hibi et al. ..... 502/325
6,857,199 B2 * 2/2005 Otani et al. ..... 34/146
6,905,645 B2 * 6/2005 Iskra ..... 264/128
6,931,759 B2 * 8/2005 Jeong et al. ..... 34/485
6,986,654 B2 * 1/2006 Imiolek et al. ..... 425/182
7,008,209 B2 * 3/2006 Iskra et al. ..... 425/182
7,022,759 B2 * 4/2006 Martin et al. ..... 524/513
7,027,887 B2 * 4/2006 Gaylo et al. ..... 700/117
7,036,243 B2 * 5/2006 Doh et al. ..... 34/595
7,040,101 B2 * 5/2006 Takeda et al. ..... 62/78
7,055,262 B2 * 6/2006 Goldberg et al. ..... 34/86
7,062,863 B2 * 6/2006 Chung ..... 34/596
7,065,904 B2 * 6/2006 Lee et al. ..... 34/601
7,073,442 B2 * 7/2006 Fedor et al. ..... 101/480
7,091,253 B2 * 8/2006 Dairoku et al. ..... 521/50
7,093,377 B2 * 8/2006 Doh et al. ..... 34/596
7,094,826 B2 * 8/2006 Martin et al. ..... 524/502
7,096,600 B2 * 8/2006 Singh ..... 34/494
7,144,945 B2 * 12/2006 Martin et al. ..... 524/501
7,166,422 B2 * 1/2007 Nakahira et al. ..... 430/505
7,172,999 B2 * 2/2007 Mattern et al. ..... 514/2
7,176,415 B2 * 2/2007 Kamitani et al. ..... 219/400
7,210,247 B2 * 5/2007 Singh ..... 34/494
7,223,813 B2 * 5/2007 Buckmann et al. ..... 524/501
7,241,003 B2 * 7/2007 Fellingham et al. ..... 347/102
7,282,091 B2 * 10/2007 Hashimoto ..... 106/163.01
7,312,973 B2 * 12/2007 Sekoguchi et al. ..... 361/231
7,320,187 B2 * 1/2008 Bancon et al. ..... 34/639
7,322,126 B2 * 1/2008 Beaulac ..... 34/554
7,325,333 B2 * 2/2008 Tadano et al. ..... 34/604
7,334,345 B2 * 2/2008 Lasonde ..... 34/181
7,353,820 B2 * 4/2008 Kumamoto et al. ..... 126/204
7,361,382 B2 * 4/2008 Tsuchimoto et al. ..... 427/162
7,370,487 B2 * 5/2008 Hayashi ..... 62/228.4
7,404,262 B2 * 7/2008 Jurkovich et al. ..... 34/381
7,406,780 B2 * 8/2008 Doh et al. ..... 34/606
7,431,956 B2 * 10/2008 Baydo et al. ..... 426/250
7,431,957 B2 * 10/2008 Baydo et al. ..... 426/250
7,501,082 B2 * 3/2009 Mencke ..... 264/40.1
7,571,969 B2 * 8/2009 Kusunoki et al. ..... 347/9
7,591,082 B2 * 9/2009 Lee et al. ..... 34/600
7,617,717 B2 * 11/2009 Luchinger ..... 73/76
7,618,732 B2 * 11/2009 Nakato et al. ..... 429/494
7,638,221 B2 * 12/2009 Nakato et al. ..... 429/493
7,655,716 B2 * 2/2010 Higuchi et al. ..... 524/236
7,665,226 B2 * 2/2010 Tsuruta et al. ..... 34/259
7,729,626 B2 * 6/2010 Kamoda et al. ..... 399/57
7,741,400 B2 * 6/2010 Dairoku et al. ..... 524/500
7,765,715 B2 * 8/2010 Kim ..... 34/491
7,784,133 B2 * 8/2010 Bang et al. ..... 8/158
7,785,398 B2 * 8/2010 Dewald et al. ..... 95/106
7,814,595 B2 * 10/2010 Kafzan ..... 8/151
7,845,198 B2 * 12/2010 Lorenz et al. ..... 68/12.04
2001/0033639 A1 * 10/2001 Martin ..... 379/88.14
2001/0040599 A1 * 11/2001 Dunand ..... 347/16
2001/0055617 A1 * 12/2001 Mattern et al. ..... 424/489
2002/0000049 A1 * 1/2002 Woerdehoff et al. ..... 34/313
2002/0003022 A1 * 1/2002 Csida et al. ..... 156/214
2002/0005257 A1 * 1/2002 Tomsovic et al. ..... 156/444
2002/0007773 A1 * 1/2002 Hietpas et al. ..... 112/475.13
2002/0016997 A1 * 2/2002 Jonsson ..... 8/159
2002/0018837 A1 * 2/2002 Lanner et al. ..... 426/560
2002/0018838 A1 * 2/2002 Zimmerman et al. ..... 426/560
2002/0022076 A1 * 2/2002 Lanner et al. ..... 426/560
2002/0028173 A1 * 3/2002 Hibi et al. ..... 423/502
2002/0028273 A1 * 3/2002 Teras et al. ..... 426/439
2002/0034571 A1 * 3/2002 Zimmerman et al. ..... 426/549
2002/0048713 A1 * 4/2002 Komoto et al. ..... 430/124
2002/0062935 A1 * 5/2002 Speaks et al. ..... 162/24
2002/0069981 A1 * 6/2002 Speaks et al. ..... 162/25
2002/0069982 A1 * 6/2002 Speaks et al. ..... 162/25
2002/0088502 A1 * 7/2002 Van Rompuy et al. ..... 141/1
2002/0095269 A1 * 7/2002 Natalini et al. ..... 702/188
2002/0133886 A1 * 9/2002 Severns et al. ..... 8/142
2002/0160290 A1 * 10/2002 Sugiura et al. ..... 430/108.1
2002/0160308 A1 * 10/2002 Nishino et al. ..... 430/271.1
2002/0166651 A1 * 11/2002 Herron ..... 164/130
2002/0174564 A1 * 11/2002 England ..... 34/606
2002/0184789 A1 * 12/2002 Gardner et al. ..... 34/491
2002/0197396 A1 * 12/2002 Haggquist ..... 427/180
2003/0050220 A1 * 3/2003 Trinh et al. ..... 510/521
2003/0059468 A1 * 3/2003 Mattern et al. ..... 424/484
2003/0061728 A1 * 4/2003 Reede et al. ..... 34/526
2003/0066638 A1 * 4/2003 Qu et al. ..... 165/186
2003/0087210 A1 * 5/2003 Nakahira et al. ..... 430/567
2003/0116177 A1 * 6/2003 Appel et al. ..... 134/18
2003/0140520 A1 * 7/2003 Anderson et al. ..... 34/576
2003/0145481 A1 * 8/2003 Zagar et al. ..... 34/83
2003/0158635 A1 * 8/2003 Pillar et al. ..... 701/1
2003/0158638 A1 * 8/2003 Yakes et al. ..... 701/22
2003/0158640 A1 * 8/2003 Pillar et al. ..... 701/33
2003/0168614 A1 * 9/2003 Vogt et al. ..... 250/492.1
2003/0180562 A1 * 9/2003 Kobayashi et al. ..... 428/482
2003/0182732 A1 * 10/2003 Davenet et al. ..... 8/158
2003/0192660 A1 * 10/2003 Speaks et al. ..... 162/72
2003/0201061 A1 * 10/2003 Csida et al. ..... 156/204
2003/0205312 A1 * 11/2003 Tomsovic et al. ..... 156/227
2003/0217480 A1 * 11/2003 Bruntz et al. ..... 34/543
2003/0221767 A1 * 12/2003 Vogt et al. ..... 156/160
2003/0224276 A1 * 12/2003 Tsuji et al. ..... 430/109.3
2003/0225390 A1 * 12/2003 Vogt et al. ..... 604/391
2003/0229404 A1 * 12/2003 Howard et al. ..... 700/17
2003/0230005 A1 * 12/2003 Lapierre ..... 34/606
2003/0232737 A1 * 12/2003 Stoessel et al. ..... 510/417
2003/0233768 A1 * 12/2003 Kaeppeler ..... 34/560
2004/0003738 A1 * 1/2004 Imiolek et al. ..... 101/480
2004/0003741 A1 * 1/2004 Iskra et al. ..... 101/487
2004/0004303 A1 * 1/2004 Iskra ..... 264/109
2004/0004653 A1 * 1/2004 Pryor et al. ..... 347/106
2004/0005182 A1 * 1/2004 Gaylo et al. ..... 400/283
2004/0005405 A1 * 1/2004 Tsuchimoto et al. ..... 427/162
2004/0007000 A1 * 1/2004 Takeda et al. ..... 62/78
2004/0010937 A1 * 1/2004 Naganawa et al. ..... 34/595
2004/0013734 A1 * 1/2004 Babcock et al. ..... 424/488
2004/0024502 A1 * 2/2004 Squires et al. ..... 701/33
2004/0030031 A1 * 2/2004 Martin et al. ..... 524/502
2004/0036486 A1 * 2/2004 Yang et al. ..... 324/694
2004/0039089 A1 * 2/2004 Buckmann et al. ..... 524/104
2004/0045096 A1 * 3/2004 Mani et al. ..... 8/142
2004/0051540 A1 * 3/2004 Tomasi et al. ..... 324/664
2004/0060197 A1 * 4/2004 Jeong et al. ..... 34/595
2004/0065125 A1 * 4/2004 Asada et al. ..... 68/12.09
2004/0080333 A1 * 4/2004 Klein ..... 324/772
2004/0088796 A1 * 5/2004 Neergaard et al. ..... 8/158
2004/0098879 A1 * 5/2004 Do ..... 34/595

2004/0103555 A1* 6/2004 Do ..... 34/549
2004/0117919 A1* 6/2004 Conrad et al. ..... 8/137
2004/0117920 A1* 6/2004 Fyvie et al. ..... 8/158
2004/0118010 A1* 6/2004 Shardlow ..... 34/595
2004/0118309 A1* 6/2004 Fedor et al. ..... 101/480
2004/0121114 A1* 6/2004 Piana et al. ..... 428/85
2004/0123489 A1* 7/2004 Pancheri et al. ..... 34/597
2004/0124807 A1* 7/2004 Nakata et al. ..... 318/801
2004/0129032 A1* 7/2004 Severns et al. ..... 68/5 C
2004/0134090 A1* 7/2004 Heilman et al. ..... 34/209
2004/0139555 A1* 7/2004 Conrad et al. ..... 8/137
2004/0143991 A1* 7/2004 Kittle ..... 34/443
2004/0143992 A1* 7/2004 Do ..... 34/446
2004/0143994 A1* 7/2004 Baron et al. ..... 34/597
2004/0157532 A1* 8/2004 Koutlakis et al. ..... 451/32
2004/0163424 A1* 8/2004 Oh et al. ..... 68/12.23
2004/0168480 A1* 9/2004 Lorenz et al. ..... 68/12.06
2004/0189462 A1* 9/2004 Eilers et al. ..... 340/531
2004/0200093 A1* 10/2004 Wunderlin et al. ..... 34/606
2004/0211228 A1* 10/2004 Nishio et al. ..... 68/12.05
2004/0216327 A1* 11/2004 Chung ..... 34/607
2004/0244390 A1* 12/2004 Bashark ..... 62/160
2004/0247918 A1* 12/2004 Hashimoto ..... 428/532
2004/0247973 A1* 12/2004 Sammes et al. ..... 429/31
2004/0259018 A1* 12/2004 Tsuji et al. ..... 430/137.15
2004/0260470 A1* 12/2004 Rast ..... 701/300
2004/0261286 A1* 12/2004 Green et al. ..... 34/527
2005/0003055 A1* 1/2005 Baydo et al. ..... 426/383
2005/0022311 A1* 2/2005 Zhang et al. ..... 8/115.51
2005/0027053 A1* 2/2005 Uchiumi et al. ..... 524/404
2005/0028806 A1* 2/2005 Kumamoto et al. ..... 126/263.02
2005/0031529 A1* 2/2005 Hibi et al. ..... 423/502
2005/0032955 A1* 2/2005 Nakano et al. ..... 524/394
2005/0034247 A1* 2/2005 Uhlin ..... 8/142
2005/0038163 A1* 2/2005 Shindome et al. ..... 524/417
2005/0044743 A1* 3/2005 Park ..... 34/544
2005/0050644 A1* 3/2005 Severns et al. ..... 8/115.51
2005/0050763 A1* 3/2005 Park et al. ..... 34/595
2005/0062486 A1* 3/2005 Qi et al. ..... 324/693
2005/0063451 A1* 3/2005 Abe et al. ..... 374/121
2005/0066538 A1* 3/2005 Goldberg et al. ..... 34/218
2005/0066541 A1* 3/2005 Singh ..... 34/494
2005/0066542 A1* 3/2005 Griffiths et al. ..... 34/597
2005/0070590 A1* 3/2005 Aoki ..... 514/410
2005/0072020 A1* 4/2005 Clodic et al. ..... 34/140
2005/0080520 A1* 4/2005 Kline et al. ..... 701/1
2005/0091755 A1* 5/2005 Conrad et al. ..... 8/137
2005/0091756 A1* 5/2005 Wright et al. ..... 8/137
2005/0091757 A1* 5/2005 Luckman et al. ..... 8/137.5
2005/0091879 A1* 5/2005 DuVal et al. ..... 34/597
2005/0092033 A1* 5/2005 Luckman et al. ..... 68/124
2005/0092035 A1* 5/2005 Shin et al. ..... 68/275
2005/0092352 A1* 5/2005 Luckman et al. ..... 134/42
2005/0097773 A1* 5/2005 Gardner ..... 34/606
2005/0099314 A1* 5/2005 Aisa ..... 340/637
2005/0107507 A1* 5/2005 Ikeda et al. ..... 524/404
2005/0120585 A1* 6/2005 Lee et al. ..... 34/602
2005/0126035 A1* 6/2005 Lee et al. ..... 34/602
2005/0132503 A1* 6/2005 Yang et al. ..... 8/149.3
2005/0132594 A1* 6/2005 Doh et al. ..... 34/73
2005/0132599 A1* 6/2005 Lee et al. ..... 34/549
2005/0132604 A1* 6/2005 Hong et al. ..... 34/603
2005/0150059 A1* 7/2005 Luckman et al. ..... 8/137
2005/0150130 A1* 7/2005 Fellingham et al. ..... 34/624
2005/0155393 A1* 7/2005 Wright et al. ..... 68/3 R
2005/0162120 A1* 7/2005 Albayrak et al. ..... 318/812
2005/0166421 A1* 8/2005 Doh et al. ..... 34/603
2005/0168907 A1* 8/2005 Sekoguchi et al. ..... 361/230
2005/0175577 A1* 8/2005 Jenkins et al. ..... 424/76.1
2005/0182180 A1* 8/2005 Martin et al. ..... 524/501
2005/0183208 A1* 8/2005 Scheper et al. ..... 8/142
2005/0186374 A1* 8/2005 Nakano et al. ..... 428/35.7
2005/0188471 A1* 9/2005 Ahn et al. ..... 8/158
2005/0210698 A1* 9/2005 Casey et al. ..... 34/134
2005/0210703 A1* 9/2005 Chung ..... 34/528
2005/0217133 A1* 10/2005 Yakumaru et al. ..... 34/134
2005/0217134 A1* 10/2005 Lasonde ..... 34/181
2005/0233062 A1* 10/2005 Hossainy et al. ..... 427/2.1
2005/0235519 A1* 10/2005 Chung ..... 34/607
2005/0251924 A1* 11/2005 Du Val et al. ..... 8/115.51
2005/0268670 A1* 12/2005 Hirasawa et al. ..... 68/12.06
2005/0277581 A1* 12/2005 Stogniew ..... 514/8
2005/0278974 A1* 12/2005 Chung ..... 34/528
2006/0005581 A1* 1/2006 Banba ..... 68/5 R
2006/0016203 A1* 1/2006 Hayashi ..... 62/228.3
2006/0026017 A1* 2/2006 Walker ..... 705/1
2006/0034984 A1* 2/2006 Baydo et al. ..... 426/250
2006/0041448 A1* 2/2006 Patterson et al. ..... 705/1
2006/0048404 A1* 3/2006 Tadano et al. ..... 34/134
2006/0048405 A1* 3/2006 Baek et al. ..... 34/443
2006/0059632 A1* 3/2006 Fyvie ..... 8/158
2006/0074014 A1* 4/2006 Stogniew et al. ..... 514/8
2006/0080819 A1* 4/2006 McAllister ..... 29/403.3
2006/0080974 A1* 4/2006 Ono et al. ..... 62/93
2006/0083710 A1* 4/2006 Joerger et al. ..... 424/76.1
2006/0101587 A1* 5/2006 Hong ..... 8/149.1
2006/0101589 A1* 5/2006 Hong et al. ..... 8/158
2006/0107547 A1* 5/2006 Baier ..... 34/546
2006/0109134 A1* 5/2006 Aisa ..... 340/662
2006/0122762 A1* 6/2006 Perkins ..... 701/102
2006/0123654 A1* 6/2006 Zhang et al. ..... 34/348
2006/0137844 A1* 6/2006 Hamada et al. ..... 162/175
2006/0150437 A1* 7/2006 Tarnowski et al. ..... 34/443
2006/0162180 A1* 7/2006 Heilman et al. ..... 34/389
2006/0162182 A1* 7/2006 Wong et al. ..... 34/486
2006/0174511 A1* 8/2006 Lee et al. ..... 34/605
2006/0179676 A1* 8/2006 Goldberg et al. ..... 34/77
2006/0179681 A1* 8/2006 Tamura et al. ..... 34/475
2006/0185403 A1* 8/2006 Ikemizu et al. ..... 68/12.18
2006/0191161 A1* 8/2006 Wunderlin et al. ..... 34/562
2006/0191901 A1* 8/2006 Taylor et al. ..... 219/521
2006/0197787 A1* 9/2006 Kusunoki et al. ..... 347/6
2006/0201017 A1* 9/2006 Ellis et al. ..... 34/276
2006/0206246 A1* 9/2006 Walker ..... 701/16
2006/0207299 A1* 9/2006 Okazaki et al. ..... 68/12.02
2006/0210768 A1* 9/2006 Masuda ..... 428/141
2006/0218976 A1* 10/2006 Lee et al. ..... 68/15
2006/0222786 A1* 10/2006 Oya et al. ..... 428/1.31
2006/0229370 A1* 10/2006 Dairoku et al. ..... 521/50
2006/0234102 A1* 10/2006 Nakato et al. ..... 429/33
2006/0236560 A1* 10/2006 Doh et al. ..... 34/596
2006/0242858 A1* 11/2006 Beaulac ..... 34/446
2006/0248658 A1* 11/2006 Ha et al. ..... 8/147
2006/0257705 A1* 11/2006 Nakato et al. ..... 429/33
2006/0270292 A1* 11/2006 Otoshi et al. ..... 442/39
2006/0286315 A1* 12/2006 Hashimoto et al. ..... 428/32.34
2006/0288605 A1* 12/2006 Carow et al. ..... 34/446
2006/0288607 A1* 12/2006 Singh ..... 34/494
2006/0288608 A1* 12/2006 Carow et al. ..... 34/604
2006/0289455 A1* 12/2006 Nakamura et al. ..... 219/494
2007/0017113 A1* 1/2007 Scharpf et al. ..... 34/86
2007/0020289 A1* 1/2007 Mattern et al. ..... 424/204.1
2007/0039200 A1* 2/2007 Hwang ..... 34/474
2007/0062513 A1* 3/2007 Gagas ..... 126/299 D
2007/0068036 A1* 3/2007 Choi ..... 34/528
2007/0072036 A1* 3/2007 Berta et al. ..... 429/33
2007/0094888 A1* 5/2007 Barron et al. ..... 34/597
2007/0098422 A1* 5/2007 Asakura et al. ..... 399/44
2007/0101602 A1* 5/2007 Bae et al. ..... 34/77
2007/0105226 A1* 5/2007 Hirano et al. ..... 436/4
2007/0107255 A1* 5/2007 Tamura et al. ..... 34/475
2007/0113421 A1* 5/2007 Uhara et al. ..... 34/275
2007/0142515 A1* 6/2007 Higuchi et al. ..... 524/236
2007/0151041 A1* 7/2007 McAllister et al. ..... 8/149.2
2007/0151129 A1* 7/2007 McAllister et al. ..... 38/3
2007/0151310 A1* 7/2007 Wright et al. ..... 68/3 R
2007/0151311 A1* 7/2007 McAllister et al. ..... 68/3 R
2007/0151312 A1* 7/2007 Bruce et al. ..... 68/3 R
2007/0160729 A1* 7/2007 Mori et al. ..... 426/520
2007/0163056 A1* 7/2007 Lee et al. ..... 8/149.2
2007/0163093 A1* 7/2007 Wright et al. ..... 28/100
2007/0163094 A1* 7/2007 Wright et al. ..... 28/100
2007/0163095 A1* 7/2007 McAllister et al. ..... 28/100
2007/0163096 A1* 7/2007 McAllister et al. ..... 28/100
2007/0163097 A1* 7/2007 Metcalfe et al. ..... 28/100
2007/0163098 A1* 7/2007 Tomasi et al. ..... 28/100
2007/0178037 A1* 8/2007 Hirano et al. ..... 423/422
2007/0180628 A1* 8/2007 Ahn ..... 8/158

2007/0186438 A1* 8/2007 Woerdehoff et al. ..... 34/486
2007/0186591 A1* 8/2007 Kim et al. ..... 68/3 R
2007/0186592 A1* 8/2007 Kim et al. ..... 68/3 R
2007/0199158 A1* 8/2007 Kafzan ..... 8/151
2007/0202376 A1* 8/2007 Nakato et al. ..... 429/33
2007/0209228 A1* 9/2007 Meerpohl et al. ..... 34/595
2007/0220683 A1* 9/2007 Kim ..... 8/158
2007/0231531 A1* 10/2007 Piana et al. ..... 428/96
2007/0245813 A1* 10/2007 Luchinger ..... 73/76
2007/0251118 A1* 11/2007 Doh ..... 34/528
2007/0259099 A1* 11/2007 Van Sciver ..... 427/2.24
2007/0259100 A1* 11/2007 Guerriero et al. ..... 427/2.24
2007/0259102 A1* 11/2007 McNiven et al. ..... 427/2.25
2007/0267086 A1* 11/2007 Dunn ..... 141/2
2007/0271811 A1* 11/2007 Tsuruta et al. ..... 34/263
2007/0283506 A1* 12/2007 Wong et al. ..... 8/149.3
2007/0283507 A1* 12/2007 Wong et al. ..... 8/149.3
2007/0283508 A1* 12/2007 Wong et al. ..... 8/149.3
2007/0285843 A1* 12/2007 Tran ..... 360/245.9
2008/0000098 A1* 1/2008 Choi et al. ..... 34/114
2008/0005924 A1* 1/2008 Yoo et al. ..... 34/524
2008/0006224 A1* 1/2008 Ahn et al. ..... 122/4 A
2008/0006300 A1* 1/2008 Ahn et al. ..... 134/18
2008/0015135 A1* 1/2008 de Buzzaccarini et al. ... 510/336
2008/0016626 A1* 1/2008 Oak et al. ..... 8/158
2008/0020221 A1* 1/2008 Witlin et al. ..... 428/515
2008/0026026 A1* 1/2008 Lu et al. ..... 424/405
2008/0031924 A1* 2/2008 Gilson et al. ..... 424/433
2008/0032011 A1* 2/2008 Liniger et al. ..... 426/250
2008/0034611 A1* 2/2008 Carow et al. ..... 34/565
2008/0034809 A1* 2/2008 Bang et al. ..... 68/12.21
2008/0036727 A1* 2/2008 Muto et al. ..... 345/101
2008/0039976 A1* 2/2008 Joo ..... 700/281
2008/0040867 A1* 2/2008 Wong et al. ..... 8/149.3
2008/0040868 A1* 2/2008 Wong et al. ..... 8/149.3
2008/0047162 A1* 2/2008 Yoo et al. ..... 34/495
2008/0052951 A1* 3/2008 Beaulac ..... 34/549
2008/0052954 A1* 3/2008 Beaulac ..... 34/572
2008/0056935 A1* 3/2008 Singh ..... 422/3
2008/0069785 A1* 3/2008 Jones ..... 424/59
2008/0092304 A1* 4/2008 Wong et al. ..... 8/149.3
2008/0099051 A1* 5/2008 Kim et al. ..... 134/18
2008/0099052 A1* 5/2008 Lee et al. ..... 134/18
2008/0115380 A1* 5/2008 Nishino et al. ..... 34/58
2008/0115539 A1* 5/2008 Nishino et al. ..... 68/12.03
2008/0115540 A1* 5/2008 Nishino et al. ..... 68/12.08
2008/0115876 A1* 5/2008 Komatsu et al. ..... 156/89.14
2008/0120868 A1* 5/2008 Morrison et al. ..... 34/572
2008/0134445 A1* 6/2008 Cho et al. ..... 8/149.1
2008/0134540 A1* 6/2008 Lasonde ..... 34/446
2008/0141550 A1* 6/2008 Bae et al. ..... 34/68
2008/0141552 A1* 6/2008 Bae et al. ..... 34/108
2008/0149561 A1* 6/2008 Chu et al. ..... 210/500.38
2008/0168679 A1* 7/2008 Son et al. ..... 34/497
2008/0170982 A1* 7/2008 Zhang et al. ..... 423/447.3
2008/0172902 A1* 7/2008 Gruber et al. ..... 34/286
2008/0196266 A1* 8/2008 Jung et al. ..... 34/140
2008/0202174 A1* 8/2008 Fabbro et al. ..... 68/212
2008/0209996 A1* 9/2008 Sprycha et al. ..... 73/150 R
2008/0210769 A1* 9/2008 Yoo et al. ..... 237/2 R
2008/0211629 A1* 9/2008 Evans et al. ..... 340/10.1
2008/0215700 A1* 9/2008 Pillar et al. ..... 709/212
2008/0221741 A1* 9/2008 Pillar et al. ..... 701/1
2008/0224646 A1* 9/2008 Boyadjieff ..... 318/622
2008/0258339 A1* 10/2008 Conrad ..... 264/293
2008/0271754 A1* 11/2008 Park et al. ..... 134/18
2008/0272934 A1* 11/2008 Wang et al. ..... 340/870.11
2008/0275177 A1* 11/2008 Chu et al. ..... 524/496
2008/0276484 A1* 11/2008 Dewald et al. ..... 34/473
2008/0276802 A1* 11/2008 Dewald et al. ..... 95/106
2008/0282568 A1* 11/2008 Oh et al. ..... 34/72
2008/0284558 A1* 11/2008 Scheiber et al. ..... 337/401
2008/0302138 A1* 12/2008 Bae et al. ..... 68/12.05
2008/0307667 A1* 12/2008 Ikemizu ..... 34/132
2008/0313920 A1* 12/2008 Finke et al. ..... 34/389
2008/0313921 A1* 12/2008 Oh et al. ..... 34/491
2008/0313922 A1* 12/2008 Bae et al. ..... 34/491
2008/0313923 A1* 12/2008 Oh et al. ..... 34/524
2008/0317489 A1* 12/2008 Kamoda et al. ..... 399/57
2008/0317914 A1* 12/2008 Baydo et al. ..... 426/250
2008/0319583 A1* 12/2008 Hagerty et al. ..... 700/269
2009/0000040 A1* 1/2009 Ikemizu ..... 8/158
2009/0004345 A1* 1/2009 Baydo et al. ..... 426/250
2009/0006970 A1* 1/2009 Jeffery et al. ..... 715/733
2009/0011293 A1* 1/2009 Wood et al. ..... 429/17
2009/0033833 A1* 2/2009 Aminaka ..... 349/68
2009/0038173 A1* 2/2009 Ahn et al. ..... 34/74
2009/0038178 A1* 2/2009 Ahn et al. ..... 34/557
2009/0049872 A1* 2/2009 Noro et al. ..... 68/18 C
2009/0056036 A1* 3/2009 Herkle et al. ..... 8/149.3
2009/0056161 A1* 3/2009 Ahn et al. ..... 34/79
2009/0056762 A1* 3/2009 Pinkowski et al. ..... 134/22.15
2009/0064421 A1* 3/2009 Lee et al. ..... 8/137
2009/0071033 A1* 3/2009 Ahn et al. ..... 34/595
2009/0076708 A1* 3/2009 Shiraishi et al. ..... 701/103
2009/0078007 A1* 3/2009 Bae et al. ..... 68/5 C
2009/0086320 A1* 4/2009 Yoshihara et al. ..... 359/493
2009/0088040 A1* 4/2009 Nishimura et al. ..... 445/51
2009/0088611 A1* 4/2009 Buschmann ..... 600/301
2009/0094853 A1* 4/2009 Noyes et al. ..... 34/233
2009/0094854 A1* 4/2009 Cimetta et al. ..... 34/562
2009/0100882 A1* 4/2009 Bae et al. ..... 68/5 C
2009/0106913 A1* 4/2009 Suel et al. ..... 8/159
2009/0107188 A1* 4/2009 Park ..... 68/5 R
2009/0112513 A1* 4/2009 Filippa et al. ..... 702/175
2009/0122237 A1* 5/2009 Fukagawa et al. ..... 349/96
2009/0126220 A1* 5/2009 Nawrot et al. ..... 34/497
2009/0126420 A1* 5/2009 Tsunemine et al. ..... 68/5 C
2009/0126423 A1* 5/2009 Bae et al. ..... 68/5 C
2009/0128168 A1* 5/2009 Qi et al. ..... 324/693
2009/0135345 A1* 5/2009 Yajima et al. ..... 349/96
2009/0139036 A1* 6/2009 Park ..... 8/149.3
2009/0139110 A1* 6/2009 Oh et al. ..... 34/553
2009/0145001 A1* 6/2009 Oh et al. ..... 34/282
2009/0166897 A1* 7/2009 Katsurayama et al. ..... 257/793
2009/0172967 A1* 7/2009 Son et al. ..... 34/318
2009/0172969 A1* 7/2009 Kim ..... 34/491
2009/0179358 A1* 7/2009 Otoshi ..... 264/449
2009/0185112 A1* 7/2009 Kawabe et al. ..... 349/96
2009/0193593 A1* 8/2009 Kirigakubo et al. ..... 8/142
2009/0211111 A1* 8/2009 Kim et al. ..... 34/526
2009/0211308 A1* 8/2009 Lorenz et al. ..... 68/12.06
2009/0223082 A1* 9/2009 Baek et al. ..... 34/497
2009/0235550 A1* 9/2009 Fluegge et al. ..... 34/127
2009/0235555 A1* 9/2009 Jie Bo ..... 34/557
2009/0241267 A1* 10/2009 Kim et al. ..... 8/149.1
2009/0241368 A1* 10/2009 Gielda et al. ..... 34/544
2009/0249639 A1* 10/2009 Kim et al. ..... 34/389
2009/0249837 A1* 10/2009 Uhara et al. ..... 68/19
2009/0255146 A1* 10/2009 Klug et al. ..... 34/491
2009/0255299 A1* 10/2009 Hiro et al. ..... 68/19
2009/0260404 A1* 10/2009 Saito et al. ..... 68/20
2009/0261500 A1* 10/2009 Ueda ..... 264/210.1
2009/0268292 A1* 10/2009 Nakai ..... 359/493
2009/0272003 A1* 11/2009 Dalton et al. ..... 34/329
2009/0272004 A1* 11/2009 Chernetski et al. ..... 34/389
2009/0272155 A1* 11/2009 Jeong et al. ..... 68/5 C
2009/0277035 A1* 11/2009 Choi et al. ..... 34/130
2009/0282694 A1* 11/2009 Magennis et al. ..... 34/337
2009/0282696 A1* 11/2009 Kim et al. ..... 34/493
2009/0288456 A1* 11/2009 Bae et al. ..... 68/5 R
2009/0288952 A1* 11/2009 Olevsky et al. ..... 204/483
2009/0293558 A1* 12/2009 Wong et al. ..... 68/5 R
2009/0293923 A1* 12/2009 Buogo et al. ..... 134/58 D
2009/0298749 A1* 12/2009 Stogniew et al. ..... 514/8
2009/0307921 A1* 12/2009 Bae et al. ..... 34/60
2010/0000269 A1* 1/2010 Shin et al. ..... 68/5 C
2010/0000581 A1* 1/2010 Doyle et al. ..... 134/99.2
2010/0003515 A1* 1/2010 Tanaka et al. ..... 428/367
2010/0011606 A1* 1/2010 Kim et al. ..... 34/60
2010/0011607 A1* 1/2010 Kim et al. ..... 34/60
2010/0011614 A1* 1/2010 Doh ..... 34/493
2010/0018262 A1* 1/2010 Beihoff et al. ..... 68/5 C
2010/0023155 A1* 1/2010 Conrad ..... 700/119
2010/0024243 A1* 2/2010 Ricklefs et al. ..... 34/474
2010/0028693 A1* 2/2010 Okafuji et al. ..... 428/423.7
2010/0037661 A1* 2/2010 Oak et al. ..... 68/17 R
2010/0047415 A1* 2/2010 Baydo et al. ..... 426/383

| | | | | |
|---|---|---|---|---|
| 2010/0051905 | A1* | 3/2010 | Iguchi et al. | 257/14 |
| 2010/0055325 | A1* | 3/2010 | Sakai et al. | 427/261 |
| 2010/0064546 | A1* | 3/2010 | Doh et al. | 34/572 |
| 2010/0083445 | A1* | 4/2010 | Kim et al. | 8/159 |
| 2010/0086675 | A1* | 4/2010 | Berta et al. | 427/115 |
| 2010/0086762 | A1* | 4/2010 | Higuchi et al. | 428/220 |
| 2010/0095548 | A1* | 4/2010 | Kim et al. | 34/73 |
| 2010/0115785 | A1* | 5/2010 | Ben-Shmuel et al. | 34/260 |
| 2010/0126032 | A1* | 5/2010 | Kim et al. | 34/79 |
| 2010/0126038 | A1* | 5/2010 | Dreossi et al. | 34/572 |
| 2010/0132128 | A1* | 6/2010 | Wong et al. | 8/137 |
| 2010/0132214 | A1* | 6/2010 | DuVal et al. | 34/389 |
| 2010/0132748 | A1* | 6/2010 | Kessler et al. | 134/93 |
| 2010/0139011 | A1* | 6/2010 | Kim et al. | 8/159 |
| 2010/0139366 | A1* | 6/2010 | Krausch | 73/23.34 |
| 2010/0141153 | A1* | 6/2010 | Recker et al. | 315/149 |
| 2010/0142935 | A1* | 6/2010 | Kim et al. | 392/394 |
| 2010/0146809 | A1* | 6/2010 | Grunert et al. | 34/443 |
| 2010/0154246 | A1* | 6/2010 | Sawa | 34/468 |
| 2010/0170046 | A1* | 7/2010 | Wong et al. | 8/137 |
| 2010/0170886 | A1* | 7/2010 | Qi et al. | 219/482 |
| 2010/0173084 | A1* | 7/2010 | Piana et al. | 427/379 |
| 2010/0174668 | A1* | 7/2010 | Finch et al. | 705/412 |
| 2010/0182136 | A1* | 7/2010 | Pryor | 340/425.5 |
| 2010/0186176 | A1* | 7/2010 | Wright et al. | 8/137 |
| 2010/0205826 | A1* | 8/2010 | Ashrafzadeh et al. | 34/499 |
| 2010/0206899 | A1* | 8/2010 | Dunn | 222/1 |
| 2010/0210745 | A1* | 8/2010 | McDaniel et al. | 521/55 |
| 2010/0218564 | A1* | 9/2010 | Aisa et al. | 68/23.1 |
| 2010/0231506 | A1* | 9/2010 | Pryor | 345/156 |
| 2010/0247908 | A1* | 9/2010 | Velev et al. | 428/365 |
| 2010/0251777 | A1* | 10/2010 | Komoto et al. | 68/20 |
| 2010/0251780 | A1* | 10/2010 | Im et al. | 68/13 R |
| 2010/0261526 | A1* | 10/2010 | Anderson et al. | 463/31 |
| 2010/0271802 | A1* | 10/2010 | Recker et al. | 362/20 |
| 2010/0281924 | A1* | 11/2010 | Tobi et al. | 68/19 |
| 2010/0288743 | A1* | 11/2010 | Kim | 219/201 |
| 2010/0300154 | A1* | 12/2010 | Nakamura et al. | 68/13 R |
| 2010/0326140 | A1* | 12/2010 | Lorenz et al. | 68/12.06 |
| 2010/0327766 | A1* | 12/2010 | Recker et al. | 315/291 |
| 2011/0000100 | A1* | 1/2011 | Malcher et al. | 34/499 |
| 2011/0005339 | A1* | 1/2011 | Ashrafzadeh et al. | 73/862.192 |

FOREIGN PATENT DOCUMENTS

| | | | | |
|---|---|---|---|---|
| EP | 351276 | * | 1/1990 | 34/524 |
| EP | 370875 | A1 * | 5/1990 | |
| EP | 427308 | A1 * | 5/1991 | |
| JP | 55109953 | A * | 8/1980 | |
| JP | 57172725 | A * | 10/1982 | |
| JP | 58063936 | A * | 4/1983 | |
| JP | 60219545 | A * | 11/1985 | |
| JP | 63133043 | A * | 6/1988 | |
| JP | 63236043 | A * | 9/1988 | |
| JP | 63236044 | A * | 9/1988 | |
| JP | 01159000 | A * | 6/1989 | |
| JP | 01178210 | A * | 7/1989 | |
| JP | 01242097 | A * | 9/1989 | |
| JP | 01260447 | A * | 10/1989 | |
| JP | 01303200 | A * | 12/1989 | |
| JP | 02017022 | A * | 1/1990 | |
| JP | 02038873 | A * | 2/1990 | |
| JP | 02057299 | A * | 2/1990 | |
| JP | 02149712 | A * | 6/1990 | |
| JP | 02156986 | A * | 6/1990 | |
| JP | 02232014 | A * | 9/1990 | |
| JP | 02249598 | A * | 10/1990 | |
| JP | 02257998 | A * | 10/1990 | |
| JP | 03134541 | A * | 6/1991 | |
| JP | 03170857 | A * | 7/1991 | |
| JP | 04003878 | A * | 1/1992 | |
| JP | 04064885 | A * | 2/1992 | |
| JP | 04171925 | A * | 6/1992 | |
| JP | 04300597 | A * | 10/1992 | |
| JP | 04307865 | A * | 10/1992 | |
| JP | 04327895 | A * | 11/1992 | |
| JP | 04348800 | A * | 12/1992 | |
| JP | 05223770 | A * | 8/1993 | |
| JP | 05245297 | A * | 9/1993 | |
| JP | 06138633 | A * | 5/1994 | |
| JP | 06254032 | A * | 9/1994 | |
| JP | 06335598 | A * | 12/1994 | |
| JP | 07178293 | A * | 7/1995 | |
| JP | 07260356 | A * | 10/1995 | |
| JP | 08261971 | A * | 10/1996 | |
| JP | 08289869 | A * | 11/1996 | |
| JP | 09244200 | A * | 9/1997 | |
| JP | 10151300 | A * | 6/1998 | |
| JP | 10211481 | A * | 8/1998 | |
| JP | 11047712 | A * | 2/1999 | |
| JP | 11325726 | A * | 11/1999 | |
| JP | 2000275356 | A * | 10/2000 | |
| JP | 2001056179 | A * | 2/2001 | |
| JP | 2001324390 | A * | 11/2001 | |
| JP | 2002282595 | A * | 10/2002 | |
| JP | 2006043421 | A * | 2/2006 | |
| KR | 20027075 | | 1/2002 | |

* cited by examiner

LAUNDRY DRYER CONTROL METHOD

This application claims the benefit of Korean Application No. 10-2002-0074067 filed on Nov. 26, 2002, which is hereby incorporated by reference.

BACKGROUND OF THE INVENTION

1. Field of the Invention

The present invention relates to a laundry drier, and more particularly, to a laundry drier control method in which a temperature variation rate per unit time is used to control drying time as needed.

2. Discussion of the Related Art

A laundry drier is an apparatus for drying wet objects, e.g., clothes, after completion of a washing cycle or the like. FIGS. 1 and 2 illustrate a laundry drier according to a related art, with FIG. 2 showing a cross-section taken along a line I-I in FIG. 1.

Referring to FIGS. 1 and 2, a drier according to a related art is comprised of a body 100 having an entrance 101 at a front side in which a door 105 is installed, a drum 30 rotatably installed in the body and having a plurality of stirrers 30*a* protruding from an inner circumferential surface of the drum, a motor 50 fixed to an inner side surface of the body to generate and transfer via a belt 60 a slow and directionally controllable rotational force with respect to the drum, first and second hot air passages 10*a* and 10*b* for guiding an air flow of external air (10*a*) to drum's interior to be discharged (10*b*) to the exterior of the laundry drier, a heater 20 installed inside the first hot air passage to heat the air therein, and an exhaust fan 40 for generating a forcible blowing force to discharge air through the second hot air passage and thereby draw in external air through the first hot air passage.

Referring to FIG. 3, illustrating a laundry drying method according to the related art, with wet laundry placed in the drum 30, drying is initiated in a step S10 to actuate each of the exhaust fan 40, the heater 20, and the motor 50. As the exhaust fan 40 starts to operate, external air is drawn in through the first hot air passage 10*a*, where it is heated by passing through the heater 20 and forcibly led into the drum 30, to evaporate the water content of laundry placed therein. Thus, the drying action is realized by a negative blowing force of the exhaust fan 40, whereby a circulation of air is achieved by drawing in external air through the first hot air passage 10*a* and discharging the air through the second hot air guide passage 10*b*. Meanwhile, the drum 30 is rotated according to a predetermined cycle, and the stirrers 30*a* pull the laundry up one side of the drum's interior to fall back down into a lower area thereof. The laundry is dried in a step S20 through the above-explained process.

As drying thus proceeds, if it is determined in a step S30 that a predetermined time has passed, the heater 20 and motor 50 are stopped in a step S40. Here, the exhaust fan 40 continues to operate for a fixed predetermined time of say, five minutes, to perform a cooling of the interior of the laundry drier in a step S50, after which the door 105 may be opened. Thus, the cooling is performed according to a procedure similar to that of the steps S20~S40 in which a constant operation is continued for a fixed duration.

As above, the laundry drier of the related art completes its assigned task by execution according to a predetermined time. That is, the drying procedure is performed for a fixed time, as set by the manufacturer, regardless of the amount or type of laundry being dried. Therefore, drying may be incomplete or excessive.

SUMMARY OF THE INVENTION

Accordingly, the present invention is directed to a method of controlling drying time of a drier that substantially obviates one or more of the problems due to limitations and disadvantages of the related art.

An object of the present invention, which has been devised to solve the foregoing problem, lies in providing a laundry drier control method which, by reading a temperature variation rate per unit time, dynamically varies the drying time according to the amount and type of an object being dried.

It is another object of the present invention to provide a laundry drier control method, by which drying is performed accurately according to the amount and type of object being dried.

It is another object of the present invention to provide a laundry drier control method, by which a proper drying is determined according to the amount and type of object being dried.

It is another object of the present invention to provide a laundry drier control method, by which improved drier operation can be achieved.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry drier control method comprising steps of initiating a drying procedure; measuring a temperature variation rate per unit time over the drying procedure; calculating an overall drying time based on the measured temperature variation rate per unit time; and performing the drying procedure for the calculated overall drying time.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

A laundry drier control method according to the present invention reads a temperature variation rate per unit time to adjust a drying time of a drying procedure according to an amount and type of objects, i.e., laundry, being dried. That is, a drying procedure according to the method of the present invention is controlled such that a drying time is determined using a temperature variation rate per unit time, from the point of initiating the drying procedure.

Figure 1:
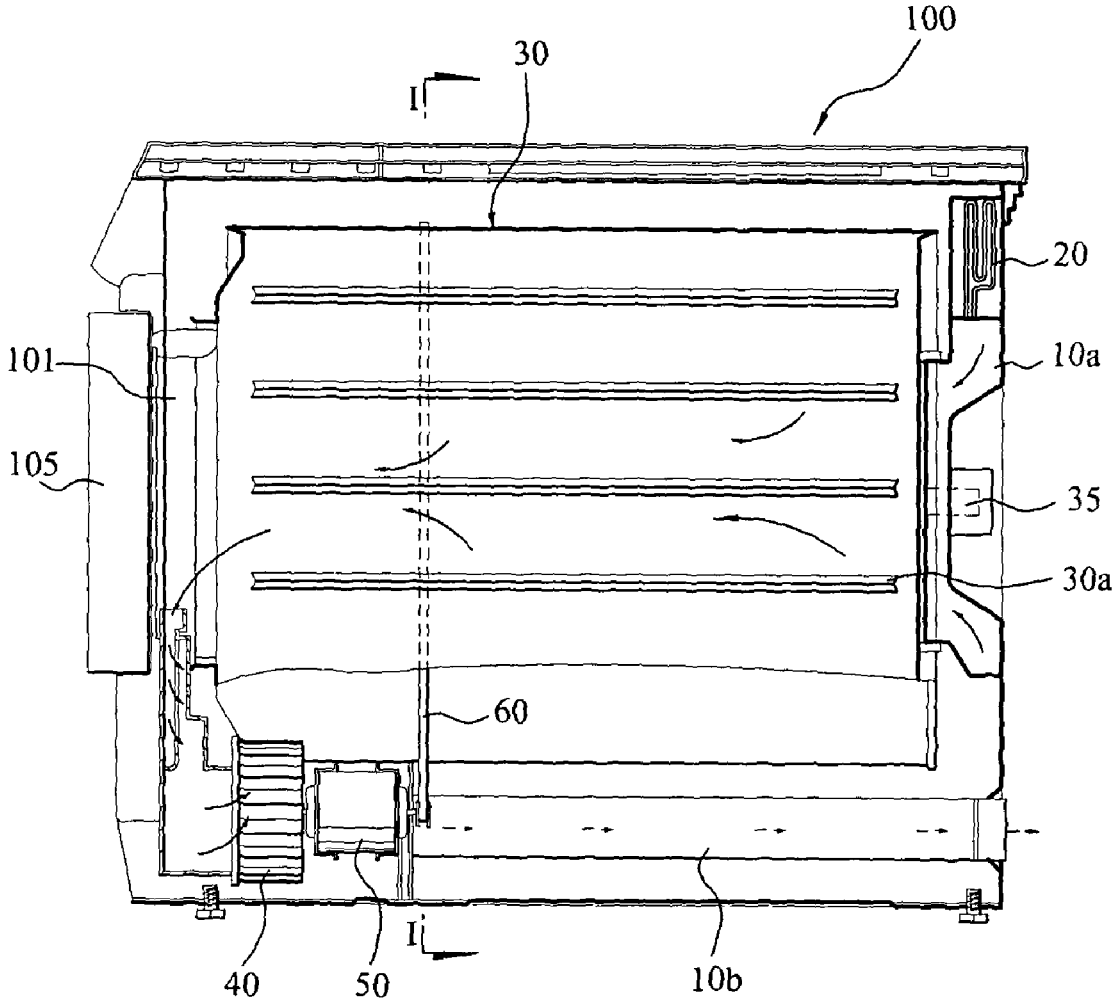
FIG. 1 Related Art
FIG. 1 is a cross-sectional view of a laundry drier according to a related art.
Figure 2:
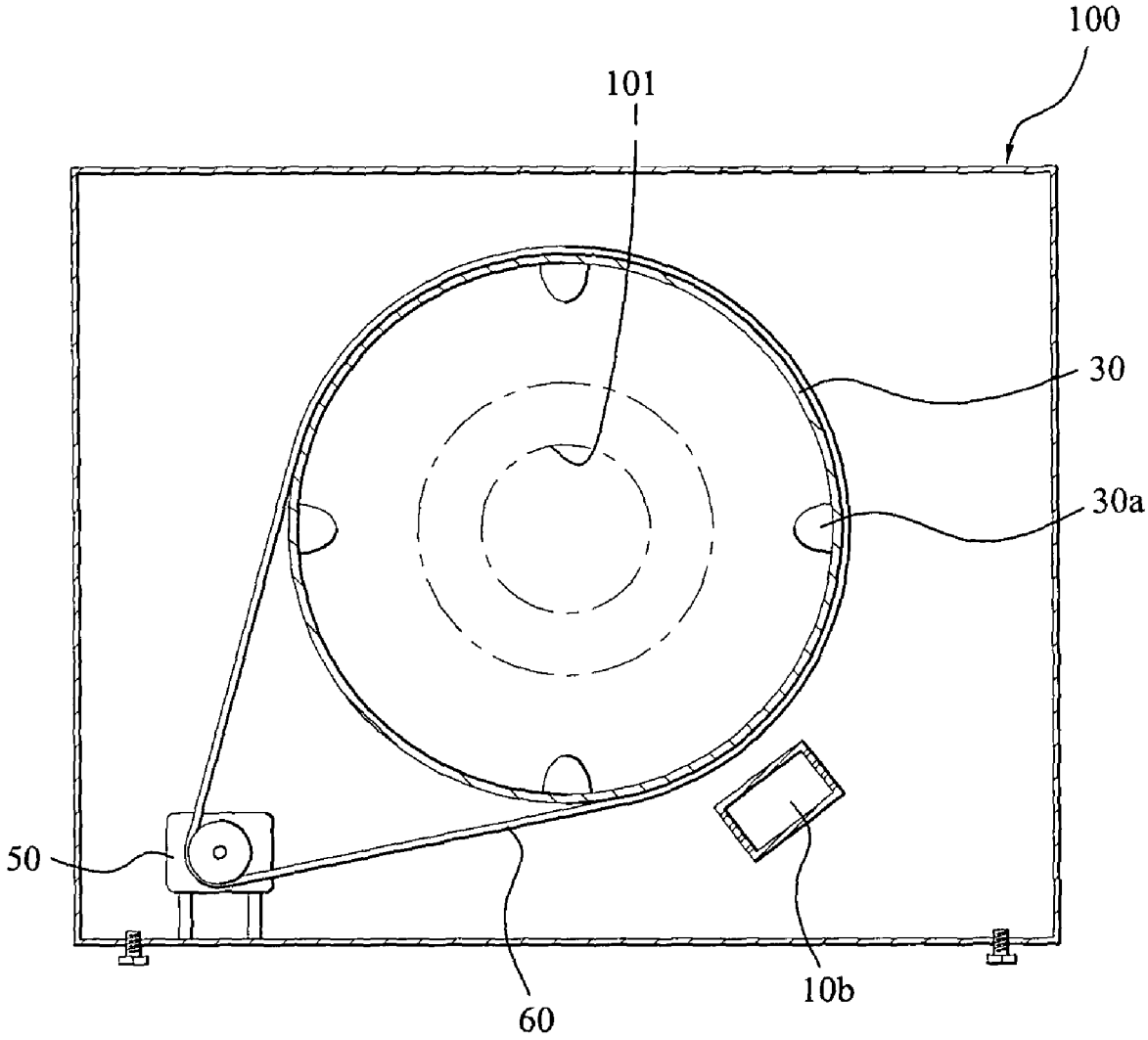
FIG. 2 Related Art
FIG. 2 is a cross-sectional view along a line I-I in FIG. 1.
Figure 3:
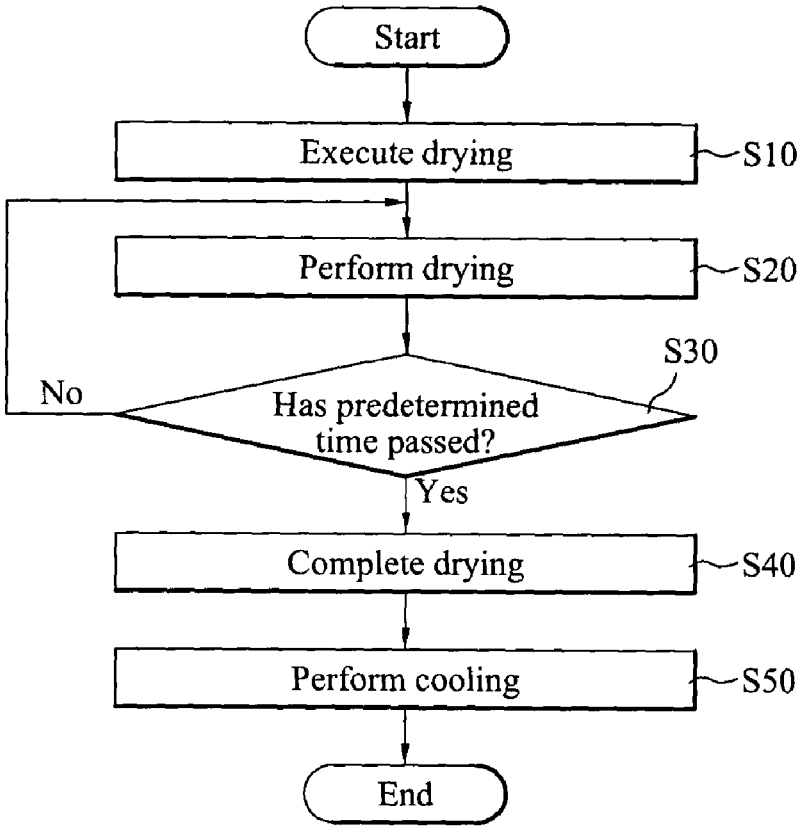
FIG. 3 Related Art
FIG. 3 is a flow chart of a laundry drying control method according to a related art.
Figure 4:
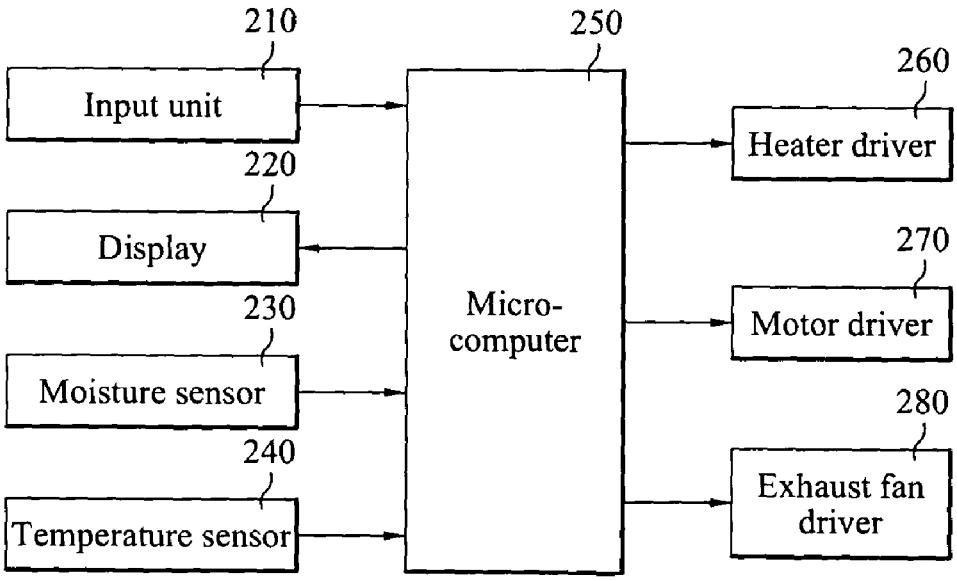
FIG. 4 is a block diagram of a laundry drier according to the present invention.

Referring to FIG. 4, a laundry drier adopting the control method according to the present invention is comprised of an input unit 210 for inputting user commands, a display 220 for displaying the respective operational states of drying and cooling procedures based on the input user commands, a moisture sensor 230 for measuring the water content of laundry during the drying procedure and for outputting a sensed water content signal, a temperature sensor 240 for detecting an internal temperature during the drying and cooling procedures and for outputting a sensed temperature signal, a microcomputer 250 for controlling the drying and cooling procedures based on the sensed signals and user command input, to determine the state of the drying procedure and to control accordingly each of heater, motor, and exhaust fan drivers 260, 270, and 280.

Upon initiating a drying procedure, the microcomputer 250 reads the temperature sensed by the temperature sensor 240 according to the drying time, whereby the temperature variation (slope) differs as the drying of a drying object proceeds. That is, the temperature varies sharply as the drying object begins to dry, varies more gradually when the drying object is substantially dried, and again varies sharply as the drying object nears a dry state.

Figure 5:
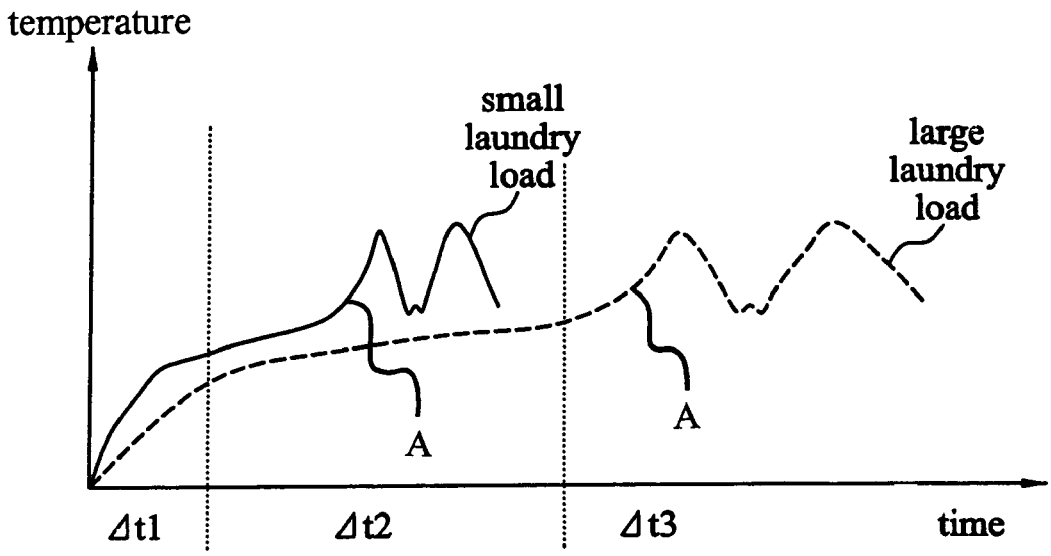
FIG. 5 is a graph of temperature over time, showing respective temperature plots for a relatively short drying time and a relatively long drying time, occurring in a laundry drier adopting a control method according to the present invention.

Referring to FIG. 5, a time period Δt1 is a period for preheating the drying object, a time period Δt2 is a period during which the drying object is substantially dried at a peak drying temperature, and a time period Δt3 is a period for high temperature drying that continues for a predetermined time after the peak drying temperature. Based on such a drying procedure, a laundry drier adopting the control method according to the present invention differentially drives the heater and motor drivers 260 and 270 for the preheating and peak drying temperature periods (Δt1 and Δt2) and for the high temperature drying period (Δt3), according to whether a maximum drying temperature has been reached. As may be seen in FIG. 5, in this embodiment, period Δt1, Δt2 and Δt3 refer to the large laundry load. Furthermore, as may be seen in FIG. 5, the incidence of the three periods over the course of the drying procedure depends on the laundry load.

Specifically, a laundry drier adopting the control method according to the present invention determines a proper drying time by sensing the variation of the temperature per unit time as the drying procedure progresses as well as sensing any change in the temperature variation rate per unit time. The temperature variation rate per unit time, measured from the initiation of the drying procedure, decreases over time at a known rate, and after a predetermined time passes, the temperature variation rate per unit time increases when the drying object is nearly dry as indicated in FIG. 5 at point A. This increase in temperature variation rate per unit time is used to calculate the remaining drying time and in turn an overall drying time. In accordance with one embodiment, this temperature variation rate may be 1° C. per minute. In other words, when a small laundry load is being dried, the drying time is reduced since the increase in the temperature variation rate per unit time occurs sooner than when a large laundry load is being dried, and vice versa.

Figure 6:
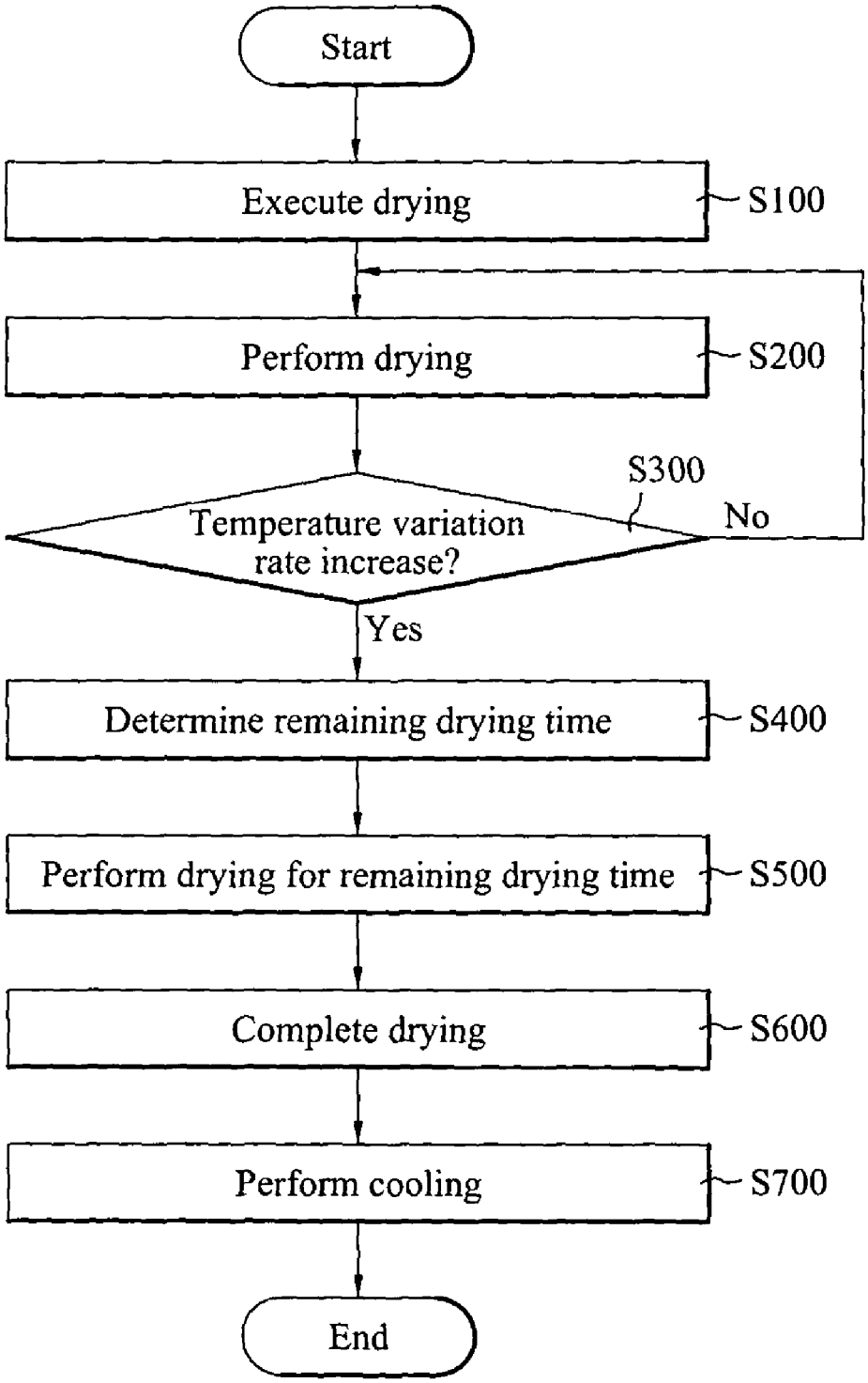
FIG. 6 is a flowchart of a laundry drier control method according to the present invention.

Referring to FIG. 6, illustrating a laundry drier control method according to the present invention, with the drying object placed in the drum 30, the input unit 210 is manipulated to initiate the drying procedure in a step S100, thus actuating the heater and motor drivers 270 and 280. In doing so, the temperature sensor 240 immediately begins outputting a sensed temperature signal to the microcomputer 250, indicating the drying temperature effected within the drum 30, and the microcomputer determines a drying temperature variation rate per unit time. In a step S200, shortly after initiating the drying procedure, the temperature rapidly rises (high rate) to a predetermined temperature set according the input from the input unit 210, and upon reaching the predetermined temperature, the drying of the drying object continues until there is no substantial variation (low rate) of the temperature. That is, based on the sensed temperature signal output from the temperature sensor 240, the microcomputer 250 determines in a step S300 whether the high temperature variation rate per unit time has been sufficiently reduced. A substantially increased rate of temperature variation indicates that the temperature inside the drier is rapidly rising, signaling that the drying object is nearly dry.

As soon as an increase in the temperature variation rate per unit time is detected, the remaining drying time is calculated in a step S400. In a step 500, the drying procedure continues for the calculated remaining time, until completion in a step S600. The microcomputer 210 then controls the display 220 to display a "drying complete" status, and the operation of the heater and motor drivers 260 and 270 is stopped. Operation of the exhaust fan driver 280 continues for a cooling procedure according to a step S700.

Accordingly, the laundry drier control method of the present invention determines the drying time after an increase in the temperature variation rate per unit time with respect to the rate at the time of initiating the drying procedure. Hence, the overall drying time can be dynamically controlled, to differentiate the drying time according to the amount and type of laundry put in the drier. Thus, an improved operation of a laundry drier is achieved by determining a proper drying time whereby drying time is reduced when the drying object (laundry load) is small or can be dried quickly and is increased for larger loads or loads that may take longer to dry.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry dryer control method comprising the steps of:

initiating a drying procedure by driving a heater for heating air and a motor for rotating a drum;

measuring temperature by a temperature sensor;

calculating a plurality of temperature variation rates;

detecting whether there is a substantial increase in the temperature variation rate with respect to the temperature variation rate of initiating the drying procedure;

calculating a remaining drying time after the substantial increased is detected; and performing the drying procedure for the calculated remaining drying time, wherein the drying procedure is divided by the difference of the temperature variation rate as the drying procedure proceeds.

2. The method as claimed in claim 1, wherein the drying procedure is divided by 3 time periods from initiating the drying procedure to completing the drying procedure.

3. The method as claimed in claim 2, wherein the first time period is a period for preheating a drying object, the second time period is a period for substantially drying the drying object, and the third time period is a period for completing the drying procedure.

4. The method as claimed in claim 3, wherein the heater the a motor are differentially driven for the first and second time period and for the third time period.

5. The method as claimed in claim 3, wherein the third time period is the remaining drying time.

6. The method as claimed in claim 1, further comprising a cooling procedure after the drying procedure.

* * * * *